US005207569A

United States Patent [19]

Knöpfel et al.

[11] Patent Number: 5,207,569

[45] Date of Patent: May 4, 1993

[54] METHOD FOR ADJUSTING A BURNER DURING THE START-UP PHASE IN A FURNACE OPERATED BY MEANS OF FLUE GAS RECIRCULATION

[75] Inventors: Hans P. Knöpfel, Besenbüren; Claude Pelet, Lonay; Hans Peter, Urdorf, all of Switzerland

[73] Assignee: Asea Brown Boveri Ltd., Baden, Switzerland

[21] Appl. No.: 868,429

[22] Filed: Apr. 15, 1992

[30] Foreign Application Priority Data

Apr. 29, 1991 [DE] Fed. Rep. of Germany ..... 4113983

[51] Int. Cl.[5] ..... F23N 5/20

[52] U.S. Cl. ..... 431/6; 431/9; 431/62

[58] Field of Search ..... 431/6, 9, 29, 30, 31, 431/20, 115, 116

[56] References Cited

U.S. PATENT DOCUMENTS 4,338,074 7/1982 Johansson ..... 431/6
4,995,807 2/1991 Rampley et al. ..... 431/9

FOREIGN PATENT DOCUMENTS 225655 6/1987 European Pat. Off. ..... 431/6
43104 3/1982 Japan ..... 431/6

*Primary Examiner*—James C. Yeung
*Attorney, Agent, or Firm*—Burns, Doane, Swecker & Mathis

[57] ABSTRACT

A method for adjusting a burner during the start-up phase in a furnace operated with recirculated flue gas (3), the furnace is subjected to a pre-flushing period prior to start-up. The furnace is started with a constant fuel amount (5), the fresh air (2) aspirated from the outside at first being reduced by means of a control. In the beginning, the stoichiometric or near-stoichiometric air balance for combustion is provided by recirculation of the fresh air (4) in the furnace. Following ignition of the burner, an increase of fresh air (2) from the outside will take place as a function of the diminishing fresh air (4) from the furnace. The diminishing fresh air (4) recirculated from the furnace is replaced by also recirculated flue gases (3) in such a way that at the end of the start-up phase only a combustion air mixture consisting of fresh air (2) from the outside and recirculated flue gases (3) is used.

6 Claims, 1 Drawing Sheet

METHOD FOR ADJUSTING A BURNER DURING THE START-UP PHASE IN A FURNACE OPERATED BY MEANS OF FLUE GAS RECIRCULATION

FIELD OF THE INVENTION

This invention relates to a method for adjusting a burner during the start-up phase in a furnace operated by means of flue gas recirculation, where the furnace is flushed prior to start-up or pre-flushing is performed.

BACKGROUND OF THE INVENTION

In accordance With clean air regulations it is necessary to assure during the operation of a furnace and also during the entire start-up phase that the maximally prescribed emission values for pollutants generated by combustion are not exceeded. For safety reasons the regulations furthermore require that the boiler be flushed with fresh air before every operation. Up to now this flushing is performed by a natural gas exchange, but mostly by the directed use of a blower. Accordingly, at the beginning there is a surplus of fresh air in the combustion air after each new operation in a furnace system operated by means of exhaust gas recirculation. This is the result of the fresh air in the combustion chamber being at first aspirated, instead of the flue gas which has not yet formed there. To place the burner into operation, the ignition of the mixture present at the start is absolutely required. However since, as described above, the mixture at first only consists of fresh air and fuel, i.e. the air regularly aspirated from the outside and a portion of air recirculated from the furnace and the constant amount of fuel, ignition already poses a problem because of the excess of fresh air. Thus, in order to achieve ignition at all, it is necessary to keep the rate of recirculation small in general. But the result of this is that following ignition, at a time when the fresh air in the furnace is being slowly replaced by flue gases, the combustion air, on account of the recirculation rate which is necessarily held low, does not contain sufficient amounts of flue gases per se, so as not to make it impossible to ignite the mixture during the start-up phase. However, a low flue gas recirculation never achieves the minimally possible pollutant emission values, so that the operation of furnaces with a mixture composition of this kind per se can hardly fulfill the legal requirements. Although it would easily be possible to increase the recirculation rate, this would mean that safe ignition of the combustion air/fuel mixture with an initial surplus of fresh air could no longer be assured or even made impossible. Accordingly, looking at it from this aspect, the only remaining possibility would be to operate with a reduced recirculation rate which, in turn, makes keeping the legal clean air regulations impossible.

OBJECT AND SUMMARY OF THE INVENTION

The invention is intended to overcome the problems noted above. An object of this invention is to provide, in a method of the type mentioned above, an improvement of the flue gas recirculation rate in respect to pollutant emission during the entire operation of the furnace, including the start-up phase, without impairing the combustibility of the mixture, particularly during the start-up phase.

An important feature of the invention is that during the start-up phase of the installation, ignition of the burner is directly assured in spite of the increase of the flue gas circulation rate, which is responsible for reducing pollutant emissions to below legal requirements. The requirements of the clean air regulations are fully complied with already during the entire start-up phase in that the selected recirculation rate operates through a control, based on the amount of flue gas generated after start-up, which acts on the adjustment of the fuel amounts or the external fresh air supply.

Thus, with one type of control, the external fresh air supply is at first reduced to compensate for the fresh air from the furnace supplied by the recirculation, so that the mixture is combustible beginning with the start-up. In this way, it is possible to keep the fuel supply constant from the beginning, i.e. no regulation of the fuel in respect to the different types of composition of the combustion air during and after start-up need be provided. Following ignition, the blow of the fresh air supply from outside will slowly be increased as a function of the decreasing amount of recirculated fresh air and increasing amounts of recirculated flue gas from the combustion chamber, until the stoichiometric equilibrium of recirculated flue gas and external fresh air as a function of the amount of fuel which is maintained constant is attained.

In another embodiment, combustibility of the mixture along with a high recirculation rate during the start-up phase is assured by acting on the fuel amount, i.e. starting at a higher level to reduce it slowly during the starting phase as a function of the increased recirculated amount of flue gas, so that at the end of the start-up phase the stoichiometrically optimal constant fuel amount for the subsequent operation of the furnace will have been attained.

A further advantage of the invention can be basically seen in that, depending on the type of furnace, either the regulation of fresh air or of fuel can be provided; in fact, it is even possible to provide a combination of fresh air and fuel regulation.

BRIEF DESCRIPTION OF THE DRAWINGS

Preferred embodiments of the invention will be described below by means of the drawings. Like elements or processes have been given the same reference numerals in the various drawing figures.

DETAILED DESCRIPTION OF THE PREFERRED EMBODIMENTS

Figure 1:
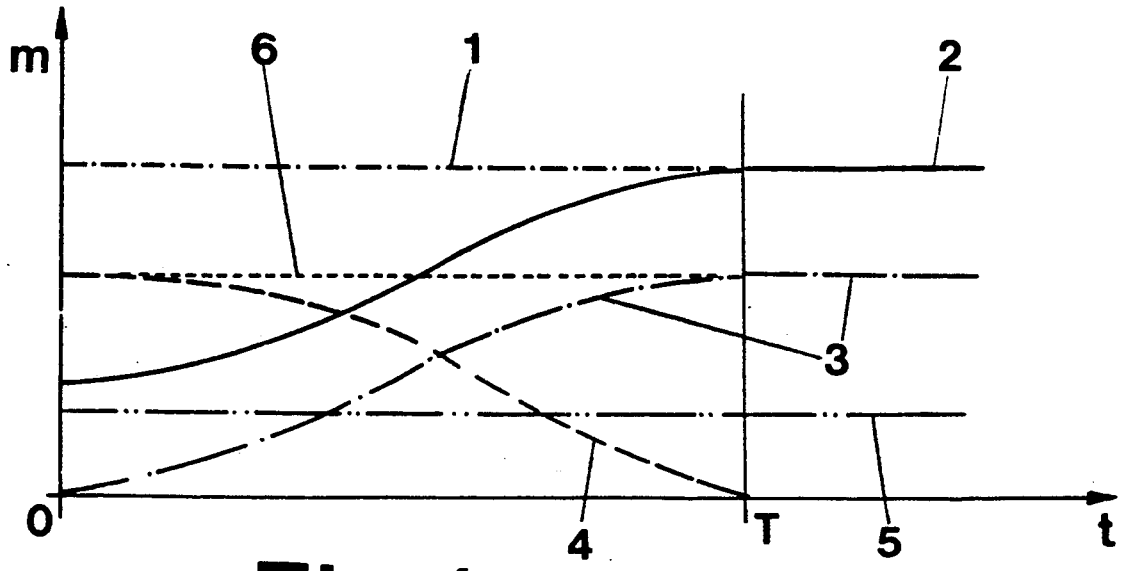
FIG. 1 is a graph showing the typical behavior of the different media during the start-up phase in connection with the fresh air regulation.

FIG. 1 shows graphically the operation of the adjustment of a burner on the basis of fresh air regulation during the start-up phase of a furnace operated with recirculation of flue gases and which is subjected to pre-flushing prior to start-up. In the coordinate system, the time t since start-up of the furnace has been qualitatively entered on the abscissa, and the progression of the amounts of the various media m has been entered on the ordinate, also qualitatively. It is initially shown that the fuel amount 5 is maintained constant over the entire start-up time and beyond. This means that this constant fuel amount 5 is designed for a qualitatively and quantitatively defined amount 1 of combustion air, which is also present after a set time T at the end of the start-up phase during the further operational phase of the furnace. At the end of the start-up phase, i.e. over the time T, this defined amount 1 of combustion air is composed of a defined portion of flue gases 3 and of a defined portion of fresh air 2 supplied from the outside, for example via a blower. The constant fuel amount 5 is designed for this amount of combustion air in its respective composition. All this is based on a preset degree of stoichiometry which, in addition to maximizing the degree of effectiveness of the furnace, also causes minimized pollutant emissions from the combustion. As clearly shown by the course of the curve, there is a zero flue gas amount 3 at the time 0, but the rising curve 3 shows that the flue gas amount rises steadily immediately following ignition up to a certain amount, which then assumes a constant character after the time T. Recirculation from the furnace takes place at the full preset amount during the entire start-up phase. However, only fresh air 4 from the previous flushing of the furnace is recirculated from the furnace immediately following the start 0. At this stage the combustion air/fuel mixture has an excess of fresh air which, in case of a constant fuel amount, would hardly permit ignition.

To remedy this, start-up takes place with a reduced amount 2 of exterior fresh air, which will slowly rise to the preset portion of the combustion mixture in the course of the start-up phase. At the same time, and with increased length of combustion, the recirculated portion of fuel gases 3 also increases, because of which the portions of fresh air 4 recirculated from the furnace will steadily decrease to zero during the continuation of the start-up phase. Accordingly, it can be stated that, during the start-up phase, the total recirculation 6 of air 4 and flue gas 3 remains approximately constant. The starting phase is considered to have ended as soon as the recirculated amount from the furnace consists only of flue gas 3. At this time, a constant amount of fresh air 2 is supplied from the outside. Accordingly, in order to assure the degree of stoichometry of the combustion, the decreasing portions of the fresh air 4 recirculated from the furnace are compensated for as a function of the increasing recirculated portions of flue gas 3 by an increase in fresh air 2 supplied from the outside in such a way that, at the end of the start-up phase, there is only a mixture of combustion air consisting of a constant portion of aspirated fresh air exclusively supplied from the outside and a constant portion of recirculated flue gas 3. Preferably, the fuel amount 5 has a ratio of 1:15 in relation to the amount of fresh air 2 after the time T. A regulation of this kind is easy to manipulate and also offers a chance to reach the desired goal by simple means. As a means for regulating the fresh air from the outside a preferred possibility is offered here, consisting of regulating the amount of fresh air in the start-up phase by means of a blower or a ventilation damper. This regulating step must of course take place very rapidly. From there on, it is clearly practical to design the course of regulation in fixed amounts or to make it controllable by means of a defined flame signal.

Figure 2:
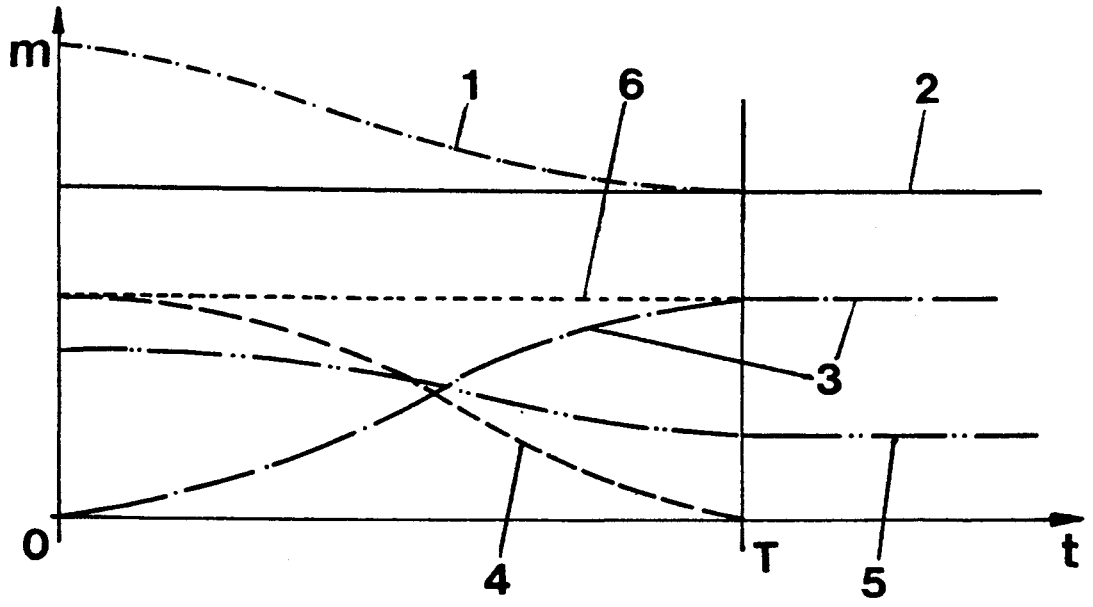
FIG. 2 is a graph showing the typical behavior of the different media during the start-up phase in connection with the fuel regulation.

FIG. 2 illustrates the opportunity to make possible the instant and assured ignition of the mixture during the start-up phase by means of the adaptation of the fuel. In this case, the fuel amount 5 is controllable, which initially only needs to be adapted to the combustion air 1 consisting of fresh air 2 from the outside, namely blower air, and air 4 recirculated from the furnace. Thus, in respect to its amount, the initial surplus of fresh air stems from the rate of recirculation from the furnace. The fuel amount 5 will be reduced during the course of start-up as a function of the increase of the recirculated flue gases 3, which slowly will replace the air 4 recirculated from the furnace. With the start-up phase completed, the fuel supply 5 then consists of that constant amount which is stoichiometrically adapted to the constant fresh air supply 2 from the outside and the constant flue gas recirculation 3. Reduction of the fresh air 4 from the furnace and the simultaneous increase of the recirculated flue gases 3 in the sense of the total recirculation 6 take place in accordance with the same pattern as already described in connection with FIG. 1.

While this invention has been illustrated and described in accordance with a preferred embodiment, it is recognized that variations and changes can be made without departing from the scope of this invention as set forth in the claims.

What is claimed is:

1. A method for operating a burner during the start-up phase of a furnace wherein the flue gas is recirculated and the furnace is flushed with air prior to start-up, the method comprising:

(a) supplying fuel to the burner at a constant rate;

(b) supplying outside air at an increasing rate to the burner during the start-up phase;

(c) supplying air from flushing the furnace to the burner at a decreasing rate during the start-up phase;

(d) maintaining during the start-up phase a substantially stoichiometric total amount-of combustion air composed of said outside air and said flushing air during the start-up phase.

2. The method according to claim 1 wherein the combined amount of flushing air and recirculated flue gas during the start-up phase remains substantially constant.

3. The method according to claim 1 wherein the fuel amount has a ratio of 1 to 15 in relation to outside air at the end of the start-up phase.

4. A method for operating a burner during the start-up phase of a furnace wherein the flue gas is recirculated and the furnace is flushed with air prior to start-up, the method comprising:

(a) supplying fuel to the burner at a rate during the start-up phase;

(b) supplying outside air at a constant rate to the burner;

(c) supplying flue gas to the burner at an increasing rate during the start-up phase;

(d) supplying air from flushing the furnace to the burner at a decreasing rate during the start-up phase;

(e) the rate of fuel supplied to the burner being reduced proportionally to the reduction in the rate of air from flushing the furnace.

5. The method according to claim 4 wherein the combined amount of flushing air and recirculated flue gas during the start-up phase remains substantially constant.

6. The method according to claim 4 wherein the fuel amount has a ratio of 1 to 15 in relation to outside air at the end of the start-up phase.

* * * * *